United States Patent [19]

Figiel

[11] 4,052,328

[45] Oct. 4, 1977

[54] AZEOTROPE-LIKE COMPOSITIONS OF TRICHLOROTRIFLUOROETHANE, ETHANOL, ISOPROPANOL AND NITROMETHANE

[75] Inventor: Francis J. Figiel, Boonton, N.J.

[73] Assignee: Allied Chemical Corporation, Morris Township, N.J.

[21] Appl. No.: 741,636

[22] Filed: Nov. 16, 1976

Related U.S. Application Data

[63] Continuation-in-part of Ser. No. 638,237, Dec. 8, 1975, abandoned.

[51] Int. Cl.[2] ..... C11D 7/50; C11D 7/32; C11D 7/30; C23G 5/02

[52] U.S. Cl. ..... 252/171; 134/38; 134/40; 252/364; 252/DIG. 9

[58] Field of Search ..... 252/170, 171, DIG. 9, 252/364, 67, 305; 260/652.5 R; 62/112; 106/311; 134/38, 40

[56] References Cited

U.S. PATENT DOCUMENTS

| | | | |
|---|---|---|---|
| 3,085,116 | 4/1963 | Kvalnes | 260/652.5 R |
| 3,549,715 | 12/1970 | Cormany et al. | 260/652.5 R |
| 3,573,213 | 3/1971 | Burt | 134/40 X |
| 3,767,585 | 10/1973 | Sawabe et al. | 260/652.5 R X |
| 3,789,006 | 1/1974 | McMillan et al. | 252/171 |
| 3,903,009 | 9/1975 | Baver et al. | 252/DIG. 9 X |
| 3,960,746 | 6/1976 | Gorski | 252/DIG. 9 X |

*Primary Examiner*—Harris A. Pitlick
*Attorney, Agent, or Firm*—Jay P. Friedenson; Alan M. Doernberg

[57] ABSTRACT

Solvent cleaning compositions composed of azeotrope-like mixtures of 1,1,2-trichloro-1,2,2-trifluoroethane, ethanol, isopropanol and nitromethane.

4 Claims, No Drawings

AZEOTROPE-LIKE COMPOSITIONS OF TRICHLOROTRIFLUOROETHANE, ETHANOL, ISOPROPANOL AND NITROMETHANE

RELATED APPLICATIONS

Co-pending application Ser. No. 638,237, filed Dec. 8, 1975 now abandoned of which this application is a continuation-in-part.

Co-pending application Ser. No. 638,235, filed Dec. 8, 1975 and continuation-in-part application thereof, Ser. No. 741,635, filed Nov. 16, 1976.

BACKGROUND OF THE INVENTION

Fluorocarbon solvents, such as 1,1,2-trichloro-1,2,2-trifluoroethane, are widely used as degreasing agents due to their excellent solvent power for greases and some emulsiontype lubricants. Trichlorotrifluoroethane also finds wide use in removing solder flux from printed circuit boards due to its selective solvency and nonflammability. Since trichlorotrifluoroethane is non-polar, it does not remove polar contaminants. Thus, to overcome this inability, trichlorotrifluoroethane has, in the past, been mixed with aliphatic alcohols.

Alcohols, while being relatively poor solvents for oils, are good solvents for polar organic acids such as abietic acid which is one of the main constituents of resin flux formulations. Furthermore, monobasic alcohols such as methanol, ethanol isopropanol, etc., dissolve certain amounts of sodium chloride and potassium chloride, and mixtures thereof with trichlorotrifluoroethane serve as solvents for, among other things, removing fingerprints from contaminated substrates, such as glass.

Mixtures of trichlorotrifluoroethane and alcohols that exhibit a minimum boiling point, i.e., azeotropic mixtures, are not flammable and retain almost all of the safety characteristics of the fluorocarbon constituent.

The use of these solvents in vapor degreasing equipment is necessary because such systems generate redistilled material for final rinse-cleaning. The vapor degreasing system acts as a still. Therefore, unless a mixture of solvents exhibit a constant boiling point, i.e., are azoetropes or azeotrope-like, fractionation will occur and undesirable solvent distribution may act to upset the cleaning and safety of the processing. It is, therefore, advantageous to develop solvent mixtures which are azeotropes or azeotrope-like. Furthermore, the more alcohols that are present in the solvent mixtures the wider the spectrum of solvency power that the mixtures will have.

A number of azeotropic and azeotrope-like mixtures of trichlorotrifluoroethane with alcohols such as methanol, ethanol and isopropanol, with or without a third component such as nitromethane, have been disclosed. Several have been used commercially as degreasing solvents. For example, U.S. Pat. No. 3,903,009 discloses the ternary azeotrope of trichlorotrifluoroethane with nitromethane and ethanol; U.S. Pat. No. 3,960,746 discloses azeotrope-like compositions comprising trichlorotrifluoroethane, methanol and nitromethane; U.S. Pat. No. 3,789,006 discloses the ternary azeotrope of trichlorotrifluoroethane with nitromethane and isopropanol; U.S. Pat. No. 3,573,213 discloses the binary azeotrope of trichlorotrifluoroethane with nitromethane; U.S. Pat. No. 3,340,199 discloses the binary azeotrope of trichlorotrifluoroethane with isopropanol; L. H. Horsley [2152] Azeotropic Data-III (Am. Chem. Society 1973) discloses the binary azeotrope of trichlorotrifluoroethane and ethanol; L. H. Horsley [1763] Azeotropic Data-III (Am. Chem. Society 1973) discloses the binary azeotrope of nitromethane and ethanol; and L. H. Horsley [1781] Azeotropic Data-III (Am. Chem. Society (1973) discloses the binary azeotrope of nitromethane and isopropanol.

There is a constant effort to develop similar solvents which have a greater versatility of solvent power.

It is the object of this invention to provide azeotropic or azeotrope-like solvent cleaning compositions which have good solvency power and versatility in solvent use.

This and other objects will become apparent from the description which follows.

DESCRIPTION OF THE INVENTION

In accordance with this invention, there are provided azeotrope-like compositions consisting essentially of about 94.8 weight percent 1,1,2-trichloro-1,2,2-trifluoroethane, about 2.4 weight percent ethanol, about 0.9 weight percent isopropanol and about 1.9 weight percent nitromethane. These compositions have a density of about 1.5 grams/ml at 25° C. and a boiling point of about 44.5° C. at 752.9 mm Hg. These compositions exhibit excellent solvency power and a great degree of versatility.

For the purpose of this discussion by azeotrope-like is intended to mean that the composition behaves like a true azeotrope in terms of its constant boiling characteristics or tendency not to fractionate upon boiling or evaporation. Such composition may or may not be a true azeotrope. Thus in such compositions, the composition of the vapor formed during boiling or evaporation is identical or substantially identical to the original liquid composition. Hence during boiling or evaporation, the liquid composition, if it changes at all, changes only to a minimal or negligible extent. This is to be contrasted to nonazeotropic or non-azeotrope-like compositions in which during boiling or evaporation the liquid composition changes to a substantial degree.

As is well known in this art, another characteristic of azeotrope-like compositions is that there is a range of compositions containing the same components in varying proportions which are azeotrope-like. All such compositions are intended to be covered by the term azeotrope-like as used herein.

The compositions according to this invention have the advantage of providing additional solvency power, due to the presence of additional alcohols, while still retaining to a great extent the nonflammability of 1,1,2-trichloro-1,2,2-trifluoroethane. The solvents of this invention may be used to clean synthetic organic polymers, plastics, resins, resin laminates, resin-bonded paper board, bakelite, fiberglass and like materials.

the azeotrope-like mixtures of this invention may be used in most of the normal applications of trichlorotrifluoroethane or its other known azeotrope-like mixtures.

The compositions of the invention may be used as solvents in conventional apparatus employing conventional operating techniques. Solvent may be used without heat if desired, but the cleaning action of the solvent may be assisted by conventional means, for example use of boiling solvent, agitation or adjuvants.

The components of the present azeotrope-like compositions are commercially available in substantially pure form. While it is preferable to have the components in substantially pure form, minor impurities will generally not adversely affect the performance of the compositions. For example, the ethanol may be denatured and still be used as the ethanol component of the solvent. The composition of this invention can be prepared by combining and admixing the constituents in about the specified proportions. Alternatively, the azeotrope-like compositions can be isolated by distillation from mixtures of the components in any proportions.

The compositions of this invention are nonflammable in air under all conditions whereas compositions containing substantially greater amounts of ethanol, isopropanol or nitromethane may become flammable on evaporation.

The azeotrope-like compositions of the present invention are particularly well suited for the cleaning of printed circuit boards contaminated with solder flux. Vapor degreasers are generally used to apply the solvent to the boards. In the conventional operation of a vapor degreaser, the board is passed through a sump of boiling solvent, which removes the bulk of the solder flux, and thereafter through a sump containing freshly distilled solvent near room temperature, and finally through solvent vapors over the boiling sump which provides a final rinse with clean pure solvent which condenses on the circuit board. In addition, the board can also be sprayed with distilled solvent before final rinsing.

The azeotropic-like nature of the present compositions insures that adequate proportions of each component will be present at all stages in the operation of a vapor degreaser. Non-azeotrope-like compositions would, through the distillation process, exhibit increasingly divergent solvent compositions in the various stages, accompanied by loss of the beneficial effect of the component reduced in concentration in the distillation process. In particular, the continued presence of nitromethane in the composition, even after repeated distillation, prevents any metal-attack caused by the presence of 1,1,2-trichloro-1,2,2-trifluoroethane and the alcohols that would occur in the absence of nitromethane.

EXAMPLE I

A distillation pot was charged with 36 grams of isopropanol, 48 grams of ethanol, 36 grams of nitromethane and 1080 grams of 1,1,2-trichloro-1,2,2-trifluoroethane and the mixture was heated. The barometric pressure was measured at 752.9 mm Hg. A constant boiling fraction at 44.5° C. was collected and found to contain all four components. Hence this fraction was determined to be azeotrope-like. Analysis by gas chromatography determined that the weight percentages of the components of this contant boiling fraction were:

| | |
|---|---|
| 1,1,2-trichloro-1,2,2-trifluoroethane | 94.8% |
| ethanol | 2.4% |
| isopropanol | 0.9% |
| nitromethane | 1.9% |

EXAMPLE II

A standard measure of solvency for certain classes of solvents is the Kauri-Butanol value. This test (ASTM 1163-61) was made on the preferred azeotrope-like composition of this invention. The established value was then compared with some binary and ternary azeotrope-like solvents. The result are given in Table I.

Table I

| Component | K-B Value* |
|---|---|
| 1. Trichlorotrifluoroethane | 30 |
| 2. Nitromethane | 11 |
| 3. Trichlorotrifluoroethane (96.2%) and Ethanol (3.8%) | 38 |
| 4. Trichlorotrifluoroethane (97.2%) and Isopropanol (2.8%) | 36 |
| 5. Trichlorotrifluoroethane (95.3%) Ethanol (3.6%) and Nitromethane (1.1%) | 39 |
| 6. Azeotrope-like composition of Example I, Trichlorotrifluoroethane (94.8%) Ethanol (2.4%) Isopropanol (0.9%) and Nitromethane (1.9%) | 40 |

*These values may vary from analyst to analyst because of the nature of the test.

EXAMPLE III

To indicate the solvency power of the compositions of this invention, the following test was conducted. A few drops of Alpha Milros flux 611, a product of Alpha Metals, Inc., was placed on copper clad printed circuit boards, then baked for 20 seconds at 550° F. over a hot plate. The boards were immersed in room temperature solvents and timed until the flux residue dissolved under constant stirring. The test was repeated for all solvents tested. The results are given in Table II.

Table II

| Component | Time in Seconds | |
|---|---|---|
| | Test No. 1 | Test No. 2 |
| 1. Trichlorotrifluoroethane (96.2%) and Ethanol (3.8%) | 60 | 55 |
| 2. Trichlorotrifluoroethane (97.2%) and Isopropanol (2.8%) | 60 | 70 |
| 3. Trichlorotrifluoroethane (95.3%) Ethanol (3.6%) and Nitromethane (1.1%) | 50 | 50 |
| 4. Azeotrope-like composition of Example I, Trichlorotrifluoroethane (94.8%) Ethanol (2.4%) Isopropanol (0.9%) and Nitromethane (1.9%) | 45 | 40 |

We claim:

1. Azeotrope-like compositions comprising about 94.8 weight percent 1,1,2-trichloro-1,2,2-trifluoroethane, about 2.4 weight percent ethanol, about 0.9 weight percent isopropanol and about 1.9 weight percent nitromethane.

2. Azeotrope-like compositions which consist essentially of the compositions defined in claim 1.

3. The method of cleaning a solid surface which comprises treating said surface with an azeotrope-like composition as defined in claim 2.

4. The method of cleaning a solid surface as described in claim 3 in which the solid surface is a printed circuit board contaminated with solder flux.

* * * * *